US006095767A

United States Patent [19]

Caughey

[11] Patent Number: 6,095,767

[45] Date of Patent: Aug. 1, 2000

[54] INDEPENDENT CEILING FAN

[76] Inventor: Shawn A. Caughey, 2820 Abbott Pl. NW., Canton, Ohio 44708

[21] Appl. No.: 09/178,020

[22] Filed: Oct. 22, 1998

[51] Int. Cl.[7] ..... F04D 25/08; F04D 29/64

[52] U.S. Cl. ..... 417/411; 416/5; 416/162

[58] Field of Search ..... 417/44.1, 45, 410.1, 417/411; 416/5, 54, 170 R, 162; 318/66

[56] References Cited

U.S. PATENT DOCUMENTS

| | | | |
|---|---|---|---|
| D. 299,855 | 2/1989 | Davis | D23/379 |
| D. 314,048 | 1/1991 | Leon, Jr. | D23/378 |
| D. 351,901 | 10/1994 | Boruch et al. | D23/328 |
| 2,077,643 | 4/1937 | Ruppe et al. | 416/161 |
| 2,909,316 | 10/1959 | Frohaczka | 416/5 |
| 4,402,649 | 9/1983 | Laurel | 416/5 |
| 4,992,709 | 2/1991 | Griffin | 318/66 |
| 5,273,402 | 12/1993 | Maury | 416/246 |
| 5,437,938 | 8/1995 | Mitsui et al. | 429/1 |
| 5,468,124 | 11/1995 | Chen | 417/411 |
| 5,586,867 | 12/1996 | Mehlos | 417/45 |
| 5,725,356 | 3/1998 | Carter | 417/411 |
| 5,851,106 | 12/1998 | Steiner et al. | 417/411 |

FOREIGN PATENT DOCUMENTS

| | | |
|---|---|---|
| 2023730 | 1/1980 | United Kingdom . |
| 1 584 264 | 2/1981 | United Kingdom . |

*Primary Examiner*—Willis R. Wolfe
*Attorney, Agent, or Firm*—Christopher J. Whewell

[57] ABSTRACT

The present invention relates to ceiling fans which are powered by rechargeable batteries. The fans do not require energy from hard-wired sources, and are hence deployable in any location desired by the user, including but not limited to watercraft, tents, remote cabins, etc. The means for receiving the battery is centrally located on the axis of rotation of the fan blades, to confer increased balance and stability to the device as a whole.

8 Claims, 4 Drawing Sheets

INDEPENDENT CEILING FAN

BACKGROUND OF THE INVENTION

This invention relates generally to electric ceiling fans employed to circulate air within the confines of various spaces. More particularly, it relates to ceiling fans that are operable in remote locations owing to their being powered by a portable, rechargeable energy source.

Ceiling fans have been known since electrical energy became available on a widespread basis to various locations at which people regularly frequent, including but not limited to offices, homes, warehouses, and virtually any other enclosed structure. Ceiling fans are currently used extensively to enhance personal comfort by providing air flow in areas that otherwise containing stagnant air. In enclosed areas they are especially useful in circulating and mixing hot air with cooler air to remove thermal gradients that tend to make rooms uncomfortable for inhabitation. During cold periods when heating is employed, ceiling mounted fans preferably circulate hot air from an upper portion of an enclosed space downwardly, and where cooling is employed as in summer months ceiling fans preferably circulate cool air upward. However, while ceiling fans have been found especially useful in providing enhanced comfort to spaces occupied by people for several decades, their use heretofore has been restricted to areas or rooms which are equipped with sufficient electrical wiring in order to provide electrical energy for the motive means used to drive the fan blades. Stated another way, locations having no electricity available must employ ventilation means other than electrical appliances, including ceiling fans.

The prior art provides ceiling fans of various designs. However, the primary requisites of the most commercially successful ceiling fans have been that the ceiling fan must include as a part of its construction a plurality of blades which are rotatably mounted to a fixture of sorts, which frequently comprises the armature of an electrical motor; a motive means for causing the rotation of said fixture, which typically comprises an electrical motor; and a source of energy by which the motive means is set into motion. Additionally, it is often desirable to arrange a cooperating collection of such elements in an aesthetically appealing configuration so as to add beauty to the decor of the room in which the fan as a whole is to be located. Most commercially-available ceiling fans intended for use within a house environment fall within this category. Exemplary of this class of ceiling fan are those sold under the Hometrends™ trademark, including but not limited to the models known as "Rainbow", "Polished Brass" and "White" marketed by Wal-Mart Stores, Inc. of Bentonville, Ark. 72716 and having various blade diameters in the range of about 30 inches to 52 inches. Another typical ceiling fan are those sold under the House Beautiful™ trademark of the Hearst Corporation and also marketed by Wal-Mart Stores, Inc. Yet another typical ceiling fan is the "New Orleans Classic"™ model of Litex Industries, Inc. of 2002 Avenue R, Grand Prarie, Tex. 75050.

In the design of the aforesaid ceiling fans, which are intended to be illustrative of those generally available in the stream of commerce and not be delimitive thereof in any way, there is typically provided a mounting means for securing the fan assembly as a whole to a ceiling, an extension bar disposed between the mounting means and a motor assembly, and a motor assembly which houses the drive motor. Generally, the armature of the drive motor is circular in dimension and has a plurality of fan blades connected to it or in mechanical contact therewith such that energization of the drive motor causes rotation of the fan blades. In general, the motor assembly which houses the motor is cylindrically shaped having a length dimension which is less than the diameter dimension. The housing is equipped with holes which serve as passageways through which air may pass by virtue of the blades rotation. In this manner, the motor is kept cool.

Generally speaking, the ceiling fans of the prior art are operated using house current which is typically delivered at a potential of 110 volts at 60 Hz. Accordingly, the motors employed as drive means are typically of the AC synchronous type. Ceiling fans exemplary in the prior art include those described in U.S. Pat. Nos. 4,689,533; 4,721,480; 4,782,213; 4,796,166; 4,810,207; 4,828,115; 4,841,188; 4,862,581; 4,900,236; 4,934,126; 5,054,376; 5,069,601; 5,072,341; 5,154,579; 5,222,864; 5,256,037; 5,333,235; 5,421,701; 5,511,943; 5,524,450; 5,558,501; 5,562,421; 5,658,129; 5,725,190; and 5,797,721, the entire contents of each of these prior-art patents being herein incorporated by reference thereto. These prior art fans generally comprise a rotatable assembly to which the fan blades are attached and a stationary assembly in or capable of being placed in connection with a suspension means. The rotary assembly comprises the rotor and the stationary assembly the stator, located coaxially inside the rotor, of an electric motor, having a common centerline. The rotatable assembly is mounted rotatably relative to the stationary assembly by means of a tubular member extending coaxially with the common centerline and a shaft located therewithin. Two bearings located at a distance one above the other are installed between the shaft and the tubular member. One of the bearings is a roller bearing. In this arrangement, the shaft is mounted in the tubular member by means of two rolling bearings, the tubular member being integral with a bottom or end dish belonging to the rotatable assembly, to which the fan blades are attached and the shaft is connected at the top thereof to the suspension means.

SUMMARY OF THE INVENTION

The present invention is a ceiling fan which may be used in any location, regardless of the presence or absence of available electrical energy. The fans of this invention comprise a means for affixing the fan assembly as a whole to a ceiling; a direct current motor; a plurality of fan blades; and a rechargeable energy source such as a rechargeable battery.

The ceiling fan of this invention comprises a stationary assembly adapted to be connected to a suspension means and a rotary assembly including a series of fan blades wherein the rotary assembly includes a rotor and the stationary assembly includes a stator of a direct current electric motor. There is also a mounting means for supporting the rotary assembly relative to the stationary assembly which includes a bearing means extending coaxially with the common centerline of the rotor and stator, as well as a means for receiving a rechargeable battery. During normal operation, the device also includes a rechargeable battery.

Rechargeable batteries are well-known in the electrical arts and include, inter alia, batteries such as gel-cells, rechargeable lithium batteries, metal hydride batteries, nickel-cadmium cells, and lead-acid storage batteries. For purposes of this specification and the appended claims the words rechargeable battery includes the aforesaid, as well as other rechargeable batteries known to those of ordinary skill in the art of electrical energy storage batteries.

The instant invention is capable of being mounted in any location where deemed desirable to hang a ceiling fan for ventillation or aesthetic purposes including but not limited to: boats, campers, recreational vehicles, vans, and tents. Additionally, the ease of removal and replacement of batteries ensures the continuous use of the device.

DETAILED DESCRIPTION

The present invention comprises a battery-powered ceiling fan which may be mounted in any location irrespective of the presence of electrical wiring located within walls, and ceilings, etc. of the structure or area in which the fan is desired to be utilized. In its simplest form, the instant invention comprises a ceiling fan constructed in accordance with those known in the prior art, with the exception that the motor is of the type powered by direct current ("DC"), and there is included in the construction a means for receiving a rechargeable energy source, which is preferably a rechargeable battery, and a rechargeable battery disposed in the aforesaid means for receiving such.

Figure 1:
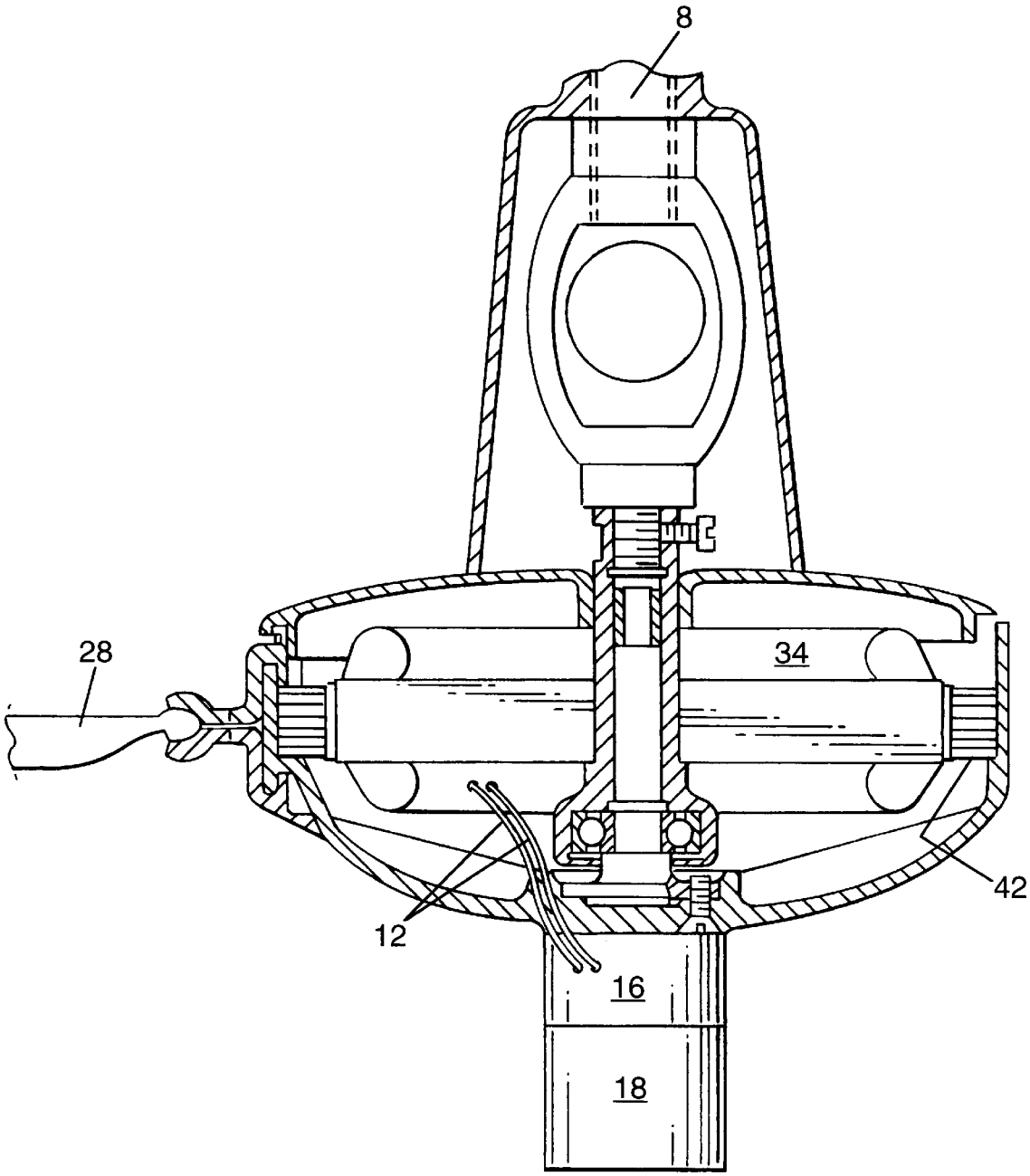
FIG. 1 is a cutaway view of a fan according to one embodiment of the invention.

FIG. 1 shows a cutaway view of a typical ceiling fan construction of prior art. The illustration of FIG. 1, as well as all of the figures herein, is intended to only be exemplary of the instant invention and should not be construed as being delimitive thereof in any way. In FIG. 1 is shown mounting rod 8; rotor 42; windings 34; battery-receiving means 16; battery 18; wiring 12; and fan blade 28. The permanent magnets of the motor are not shown. In this figure, the preferred location of the battery-receiving means is shown, as also shown in FIGS. 2, 3, and 4.

Figure 2:
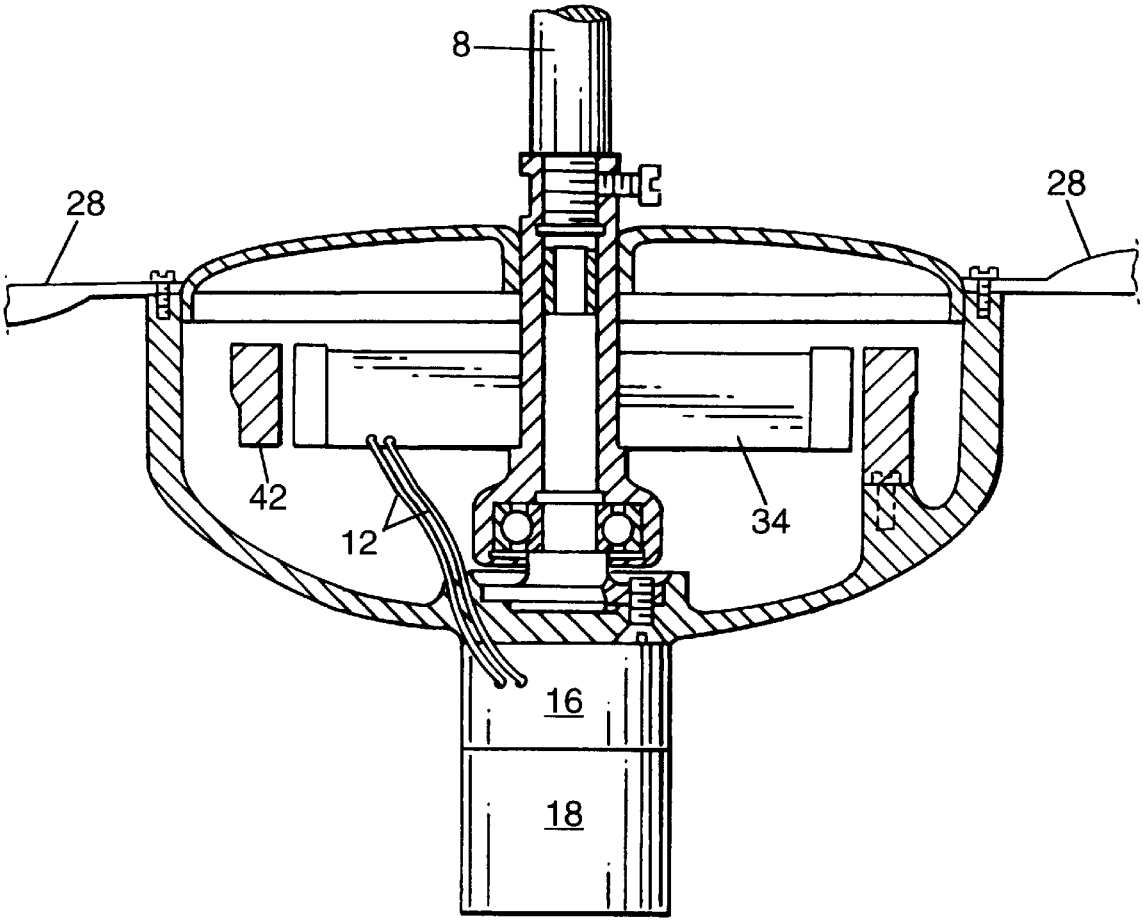
FIG. 2 is a cutaway view of a fan according to one embodiment of the invention.

FIG. 2 shows a cutaway view of another typical ceiling fan construction of prior art. The illustration of FIG. 1, as well as all of the figures herein, is intended to only be exemplary of the instant invention and should not be construed as being delimitive thereof in any way. In FIG. 1 is shown mounting rod 8; rotor 42; windings 34; battery-receiving means 16; battery 18; wiring 12; and fan blade 28. The permanent magnets of the motor are not shown.

Figure 3:
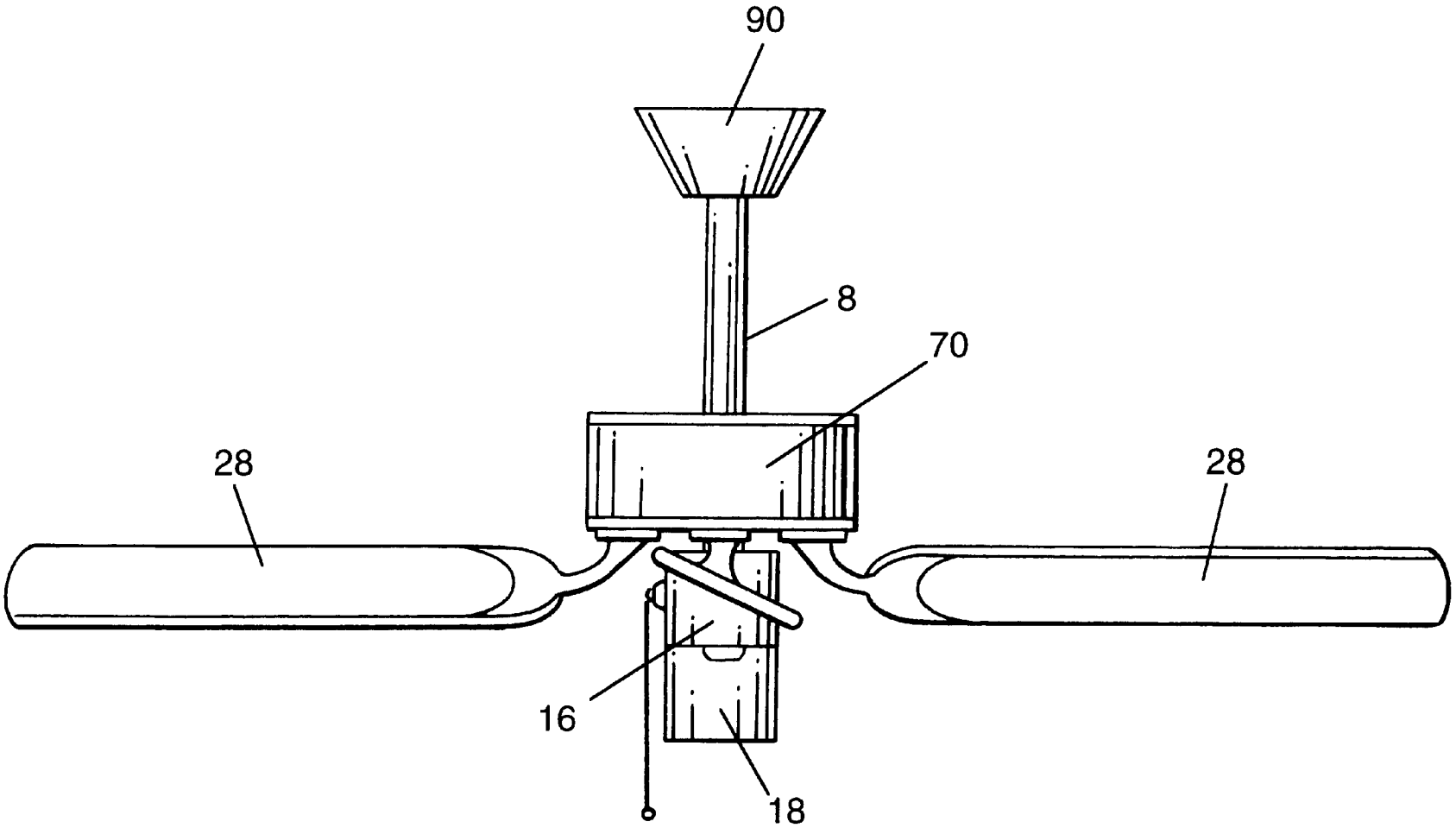
FIG. 3 is a side view of a complete fan according to the invention.

FIG. 3 depicts a side view of a complete ceiling fan according to the instant invention, showing the location of the battery and battery-receiving means at the center of rotation of the fan blades.

Figure 4:
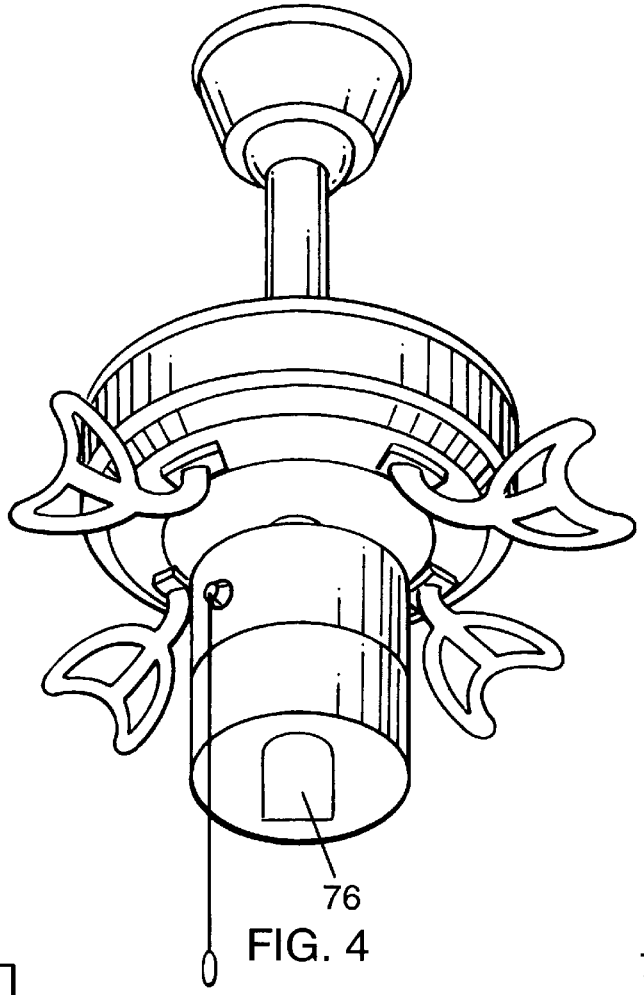
FIG. 4 is a perspective view of a fan according to the invention, less the fan blades

FIG. 4 shows a perspective view of a fan according to this invention, illustrating the opening 76 on the battery-receiving means into which a mating counterpart from a rechargeable battery is inserted during the battery exchange procedure employed in accordance with the use of a fan according to this invention.

Figure 5A:
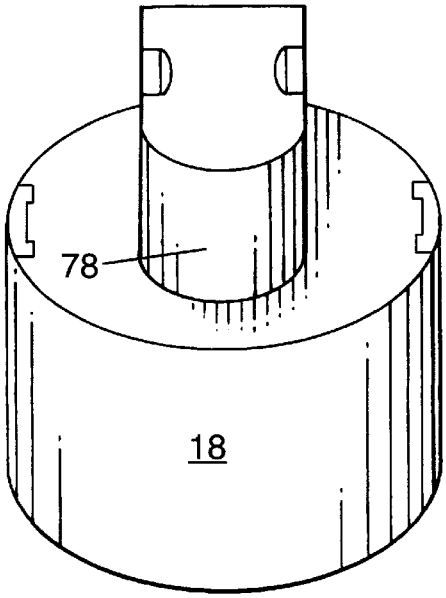
FIG. 5A is a perspective view of a battery configuration suitable for use in the invention.
Figure 5B:
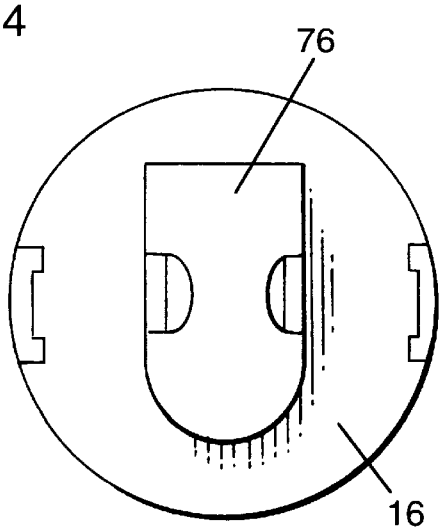
FIG. 5B is a perspective view of a battery-receiving means suitable for use in the inveniton.

FIG. 5A shows a rechargeable battery 18 useful in accordance with the instant invention, while FIG. 5B shows a battery receiving means 16 capable of receiving said rechargeable battery.

The mounting means useful in affixing the fan of this invention to a ceiling or other surface may be of any mounting means known to those skilled in the arts of either electrical lighting appliance mounting or the mounting of temporary fixtures to stationary surfaces. Such means include, but are not limited to screws, bolts, adhesives, suction cups, and toggle bolts. The mounting means includes an anchoring portion 90 (FIG. 3) which is securely affixed to the stationary surface which it is desired that the ceiling fan be mounted to. There is a mounting rod disposed between the anchoring portion and the stationary assembly 70 (FIG. 3) of the fan assembly. The mounting rod may be of any selected length and its purpose, as is well known to those skilled in the art, is to hold the fan in position at a desired height from the floor or ceiling.

A fan, for purposes of this specification and the appended claims is an electrical motor with a portion that rotates when an electrical potential is applied to the windings of the motor and having at least one blade portion attached to the rotating portion of the motor such that the air surrounding the motor is caused to be circulated in either a random or regular pattern.

The motor used in the instant invention comprises a conventional direct-current motor whose voltage rating is matched to that of the battery employed. Although it is possible, as is known to those of ordinary skill in the electrical arts, to have the blades of the fan be an attached part of either the rotor or the stator of the electrical motor and still have the device function in the capacity of a fan, it is preferred in this invention that the blades are part of the rotor. The preferred configuration comprises a stationary assembly which includes the stator portion of the motor connected or affixed to the stationary assembly such that the stator portion of the motor does not move with respect to the stationary assembly when the motor is energized. The motor also includes a rotatable portion which includes the rotor upon or to which the fan blade(s) are affixed.

As previously mentioned, the battery employed as the rechargeable energy source according to the invention may be any rechargeable battery known to those skilled in the art. However, the most preferred battery is that known as Model Q103 sold by the Black and Decker tool company of Towson, Md. 21286, or its functional equivalent. This type of battery is preferred since it has a relatively high capacity, and because it is of the type which lends itself well to be rapidly interchanged in a battery-receiving means by virtue of its original design, which was the integral part of a handtool. An exemplary handtool is the Model Q140K drill sold by Black and Decker. In the configuration of this hand-held drill, the battery fits into the handle portion of the drill in much the same way as the ammunition magazine fits in the handle of the famous automatic pistol invented by John Browning. The battery-receiving means preferably includes a hollow, substantially cylindrically-shaped void (female socket) 76 (FIG. 5) into which a substantially cylindrically-shaped solid portion (male portion) 78 (FIG. 5) complementary to said void is designed to fit. The female portion is a part of the fan construction, and is equipped with electrical contacts on its interior that are connected to the windings of the motor by means of wires 12 in the various figures. The electrical contacts are adapted to mate with, preferably in sliding contact, and provide electrical contact with terminals on the male portion of the rechargeable battery, when the latter is inserted into the former. In this way the electrical energy stored in the battery may be transmitted to the motor. Such an arrangement is the preferred configuration and means for conveying electrical energy from the energy source to the motor. This configuration is preferred since it provides balance to the fan as a whole during its operation, and is not aesthetically objectionable. Other functionally equivalent means for removably attaching the battery in accordance with this invention are herein indicated as having utility herein, including, but not being limited to slots and grooves, locator pins and screws, velcro, brackets, snaps, etc. The only requisite is that the battery is made to be in electrical contact with the motor, and is securely held in place at the center of rotation of the fan so as to maintain, and optionally contribute, to the overall balance of the fan unit as a whole.

Switch means may be employed, the use of which is known to those of ordinary skill in the electrical arts, to make or break the electrical circuit and function as an on/off switch, or to reverse the polarity of the electricity to the motor and thus conferring easy control over the direction of rotation of the fan blades.

There is also provided a means for holding the battery in place once it is pushed into position. These means, which may be of several types known in the art, preferably comprise plastic catch members which may are normally biased to hold the battery in position once it has been inserted and may be squeezed together to provide easy release of a battery from its receiving means. Such release means are well-known in the art.

Consideration must be given to the fact that although this invention has been shown and described with respect to certain preferred embodiments, it is obvious that equivalent alterations and modifications will occur to others skilled in the art upon the reading and understanding of this specification and the claims appended hereto. The present invention includes all such equivalent alterations and modifications, and is limited only by the scope of the claims which follow.

I claim:

1. A ceiling fan which comprises:

a) a stationary assembly adapted to be connected to a suspension means and a rotary assembly including a series of fan blades whereirn said rotary assembly includes a rotor and the stationary assembly includes a stator of a direct current electric motor;

b) a mounting means for supoprting said rotary assembly relative to said stationary assembly which includes a bearing means extending coaxially with the common centerline of said rotor and stator; and c) means for receiving a rechargeable battery, wherein said means for receiving a rechargeable battery includes a plurality of electrical contact strips in electrical contact with the windings of said direct current motor.

2. The fan of claim 1 wherein said m eans for receiving a rechargeable battery is located along the axis of revolution of the blades of said fan.

3. The fan of claim 1 further comprising a rechargeable battery.

4. The fan of claim 3 wherein said battery is selected from the group consisting of: nickel-cadmium, metal hybride, lithium, and rechargeable alkaline batteries.

5. The fan of claim 1 further comprising at least one fan blade in mechanical contact with said rotor.

6. The fan of claim 5 wherein said battery is located substantially at the center of rotation of said rotor.

7. A process for operating an electrical motor-driven ceiling fan comprising the steps of:

i) providing said fan with a means for receiving a battery, wherein said means for receiving a battery includes a plurality of terminal strips in electrical contact with the windings of said motor; and ii) providing a battery into said means for receiving a battery such that the terminals of said battery are in electrical contact with said terminal strips.

8. The process according to claim 7 wherein said battery is located at the axis of revolution of the blades of said fan.

* * * * *